United States Patent [19]

Schawel

[11] 4,423,734

[45] Jan. 3, 1984

[54] NURSING BRA WITH NURSING INDICATOR

[76] Inventor: Pamela G. Schawel, 344 S. Elm St., Itasca, Ill. 60143

[21] Appl. No.: 429,427

[22] Filed: Sep. 30, 1982

Related U.S. Application Data

[63] Continuation of Ser. No. 360,622, Mar. 22, 1982.

[51] Int. Cl.[3] ..... A41C 3/04; G09F 21/02

[52] U.S. Cl. ..... 128/460; 40/586

[58] Field of Search ..... 128/460; 2/104, 586, 2/246; 128/150

[56] References Cited

U.S. PATENT DOCUMENTS

| | | | |
|---|---|---|---|
| 3,472,198 | 10/1969 | Rimelker | 40/586 |
| 3,582,993 | 6/1971 | Keller | 40/586 |
| 3,748,767 | 7/1973 | Giersucker | 40/491 |

OTHER PUBLICATIONS

Brochure (undated) by Nursemate of Wenatchee, Washington, entitled, "Nursing Products for Nursing Mothers".

*Primary Examiner*—Doris L. Troutman

*Attorney, Agent, or Firm*—Allegretti, Newitt, Witcoff & McAndrews, Ltd.

[57] ABSTRACT

The disclosure describes a nursing bra that has an integral device to indicate which breast should be used when starting a breast feeding of an infant. At least some part of the device is permanently fastened to the bra. In preferred form, the device includes a base member and a designating member. The base member is attached to the nursing bra, and the designating member is attached to the base member. The designating member may be moved from side to side in relation to the base member. The breast to be used in starting a feed is indicated by the location of the indicator, i.e., as part of the routine for each feeding, the mother positions the designating member such that she will know which breast to use in starting the next feeding.

9 Claims, 13 Drawing Figures

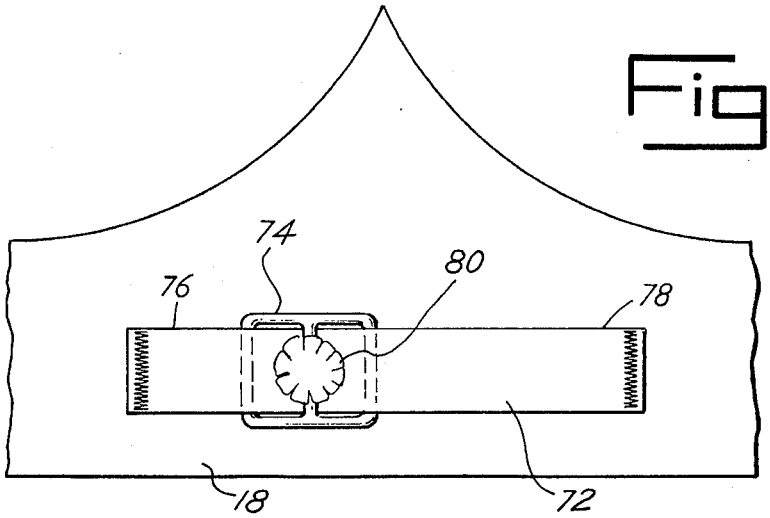
Fig. 6
Fig. 7A
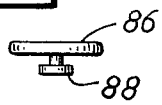
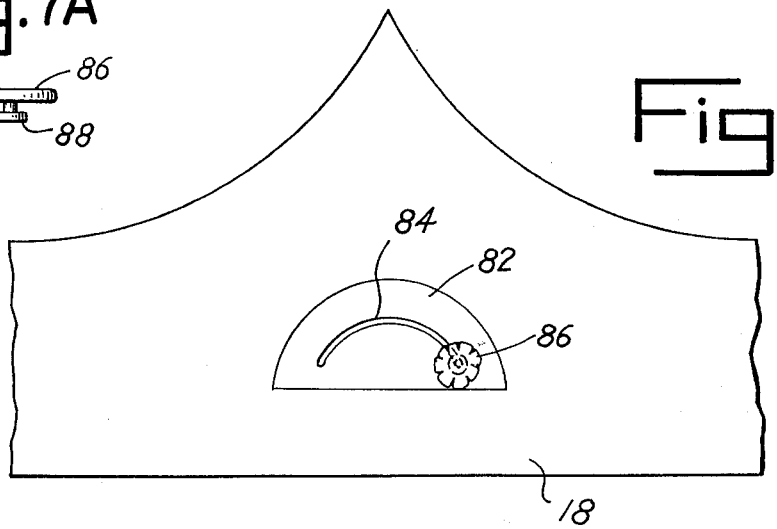
Fig. 7
Fig. 8A
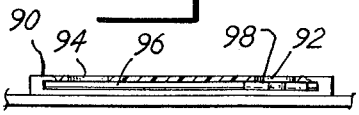
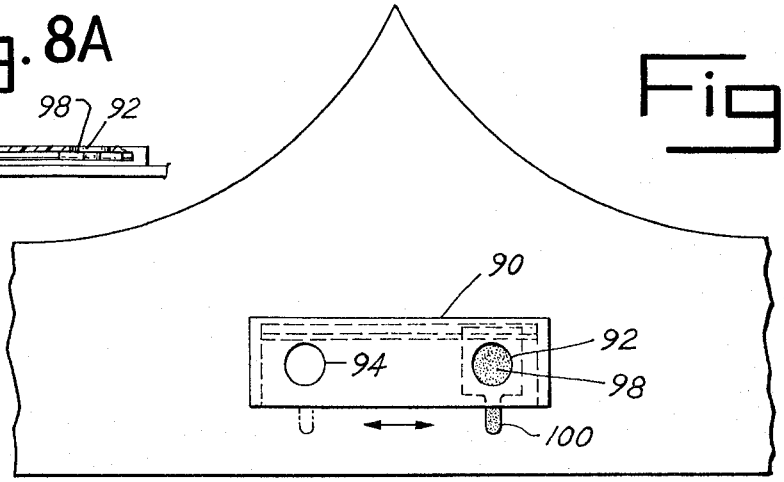
Fig. 8

NURSING BRA WITH NURSING INDICATOR

This is a continuation of application Ser. No. 360,622, filed Mar. 22, 1982.

BACKGROUND OF THE INVENTION

This invention relates to nursing bras and, more specifically, to a nursing bra with an integral indicator to designate which breast to use first in starting an infant's feed.

When mothers choose to breast feed their newborn children, they should insure that they alternate the breast used to start each feeding. Infants suck hard initially during a feed, because they are relatively hungry, and suck softer later. The strong sucking action produces both a benefit and a strain on the mother's breast and nipple. The benefit and the strain can be effectively balanced by alternating the breast with which a mother starts each feed. More specifically, failure to alternate the starting breast often produces soreness, swelling of the nipple, and can lead to lower milk production from the lesser used breast. Regular alternation of the breast used to start a feed aids proper emptying of each breast and thereby reduces the chance of breast infection and pain-producing obstructions in the breast's milk ducts.

Nursing mothers, taxed with the new and disorienting burden of properly caring for an infant child, frequently requiring them to alternate several hours of sleep with several hours of activity without regard to whether it is day or night, can easily forget which breast was used first at a last feeding and which should be used first at a present feeding. Such forgetfulness often results in a mother failing to properly alternate the breast used to start a feeding, which in turn can lead to the problems previously described. Nursing mothers should therefore have some way to know which breast was used first at the last feeding and to designate the breast to be used first for the next feeding.

Notwithstanding that bras especially designed for nursing mothers have been available for many years, none of the prior nursing bras of which this inventor is aware provide a solution to this problem. In the past, the only recognized technique, other than memory, was for the mother to fasten a safety pin to her brassiere. The safety pin reminded the mother of her location in the sequence of breast alternation.

Safety pins as nursing indicators have a number of disadvantages. They pose a risk to mother and child; they are time-consuming and inconvenient to use. Nursing mothers generally must exercise extreme care to avoid sticking the infant or herself with the pin's pointed end. Such care is especially difficult to practice when mothers are in the awkward but common position of holding the infant with one arm and transferring the safety pin with the remaining free hand. Of course, the risk of injury can be largely avoided by setting the child down and using both hands, but this is impracticle. A nursing mother must often cease nursing and quickly walk somewhere without putting the baby downd—as, for example, when she must answer the telephone, or when the baby falls asleep and she wants to put it quickly in its crib. The hurried fumbling with a safety pin in such situations, often with only one hand available, produces unnecessary danger to the infant or mother and may induce the mother to abandon the safety pin and rely on her imperfect memory.

Safety pins also produce aesthetically undesirable effects. A safety pin clipped to a brassiere is unsightly and can produce discomfort when worn under clothing. Safety pins can also leave stains or rust spots on a brassiere, because the pin, to properly perform its designated function and always be available when needed, is often left attached to the brassiere during washings.

SUMMARY OF THE INVENTION

It is accordingly an important object of this invention to provide a nursing bra having a nursing indicator.

It is another object of this invention to provide a nursing bra by which the breast used to start a feeding can be quickly, conveniently, and easily designated.

It is a further object of the present invention to provide a nursing bra by which the breast used to start a feeding can be safely designated without risk of injury to mother or child.

It is a still further object of this invention to provide a nursing bra wherein the foregoing objects may be accomplished by a mother using only one hand.

Yet a further object of the present invention is to provide a nursing bra by which the foregoing objects can be accomplished without risk of stain or discoloration of the bra.

Further purposes, objects and aspects of this invention will appear as the specification proceeds.

The present invention represents an improvement in nursing bras, such as those which commonly have left and right breast cups that are at least partially detachable to form an opening near the left or right breast, respectively. The improved nursing bra includes a nursing indicator, at least some part of which is permanently and continuously fastened to the bra, to record which breast is to be used next when starting a breast feed of an infant. The nursing indicator contains a designating member which can be safely and easily alternated from left to right, preferably using only one hand. The mother, as part of the routine for each feeding, positions the designator in a manner such that she can see or feel the position of the designating member of the nursing indicator, and thereby know which breast to use when staring the next feeding.

The nursing indicator may be positioned virtually anywhere on the bra. The most convenient location for manipulating the device (i.e., operating it so as to indicate either a right or left breast) or for seeing or feeling the location of the designating member is preferably on the front of the bra between the right and left breast cups.

The nursing indicator of this invention may be of many different constructions. Several of these constructions are shown in the drawing, and preferred designs are described more fully herein. Generally, the device includes a base member that is fastened to the bra and a designating member that is affixed to the base member.

The designating member is perferably affixed to the base member in a manner that permits movement of at least some portion of the designating member relative to at least some portion of the base member. Generally, the relative movement will be in a right to left direction, or vice versa, relative to the wearer, but in any event movement of the designating member will correspond to such direction. In this way, the designating member is moved to indicate either the left or right breast as being the one which should start the next feeding.

In one preferred embodiment, described more fully hereinafter, the base member defines a track and the designating member includes an insert mounted so as to slide along the track between a left and right position. It is preferred that the nursing indicator provide a mechanism for securing the designating member in either of the left or right positions, such that it will not inadvertently change position.

These and other features of my invention will be described more fully in the section which follows.

DESCRIPTION OF THE DRAWINGS

A preferred and several alternate embodiments are illustrated in the accompanying drawings wherein:

FIG. 6 is a close-up horizontal view of a third alternate embodiment of the nursing indicator utilized with the invention;

FIG. 7 is a close-up horizontal view of a fourth alternate embodiment of the nursing indicator utilized with the invention;

FIG. 7A is a cross-section view of the designating member shown in FIG. 7;

FIG. 8 is a close-up horizontal view of a fifth alternate embodiment of the nursing indicator utilized with the invention;

FIG. 8A is a cross-section view of FIG. 8;

DETAILED DESCRIPTION OF THE PREFERRED EMBODIMENT

Figure 1:
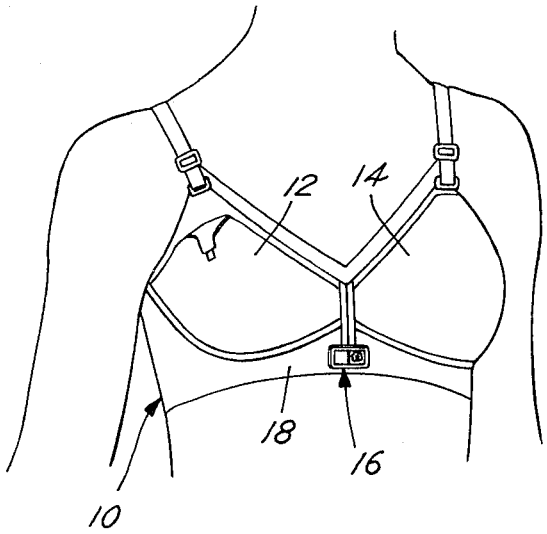
FIG. 1 is a horizontal, front view of a nursing bra embodying a preferred form of the present invention.

The present invention improves conventional nursing bras of the type that are well known to those of ordinary skill in the art. As illustrated in FIG. 1, a nursing bra 10 includes left and right breast cups 12 and 14, respectively, that are at least partially detachable to form openings near the left and right breasts, respectively.

Normally, a nursing bra has an elastic band 18 which fits around the woman's chest to assist in securing the bra 10. The nursing indicator 16 is normally best positioned in the front center of the elastic band 18, between the left and right breast cups 12 and 14. Positioning the nursing indicator 16 in this location provides easiest access to the mother for operating, inspecting or feeling the nursing indicator.

Figure 2:
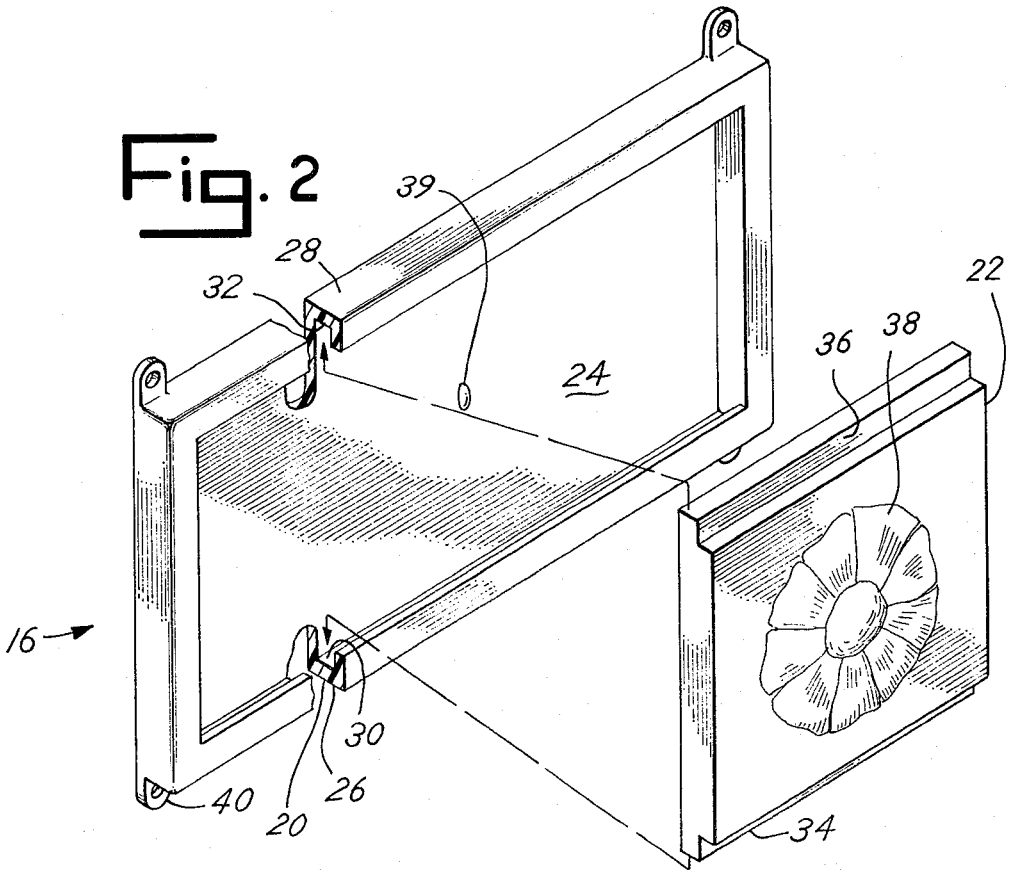
FIG. 2 is an exploded perspective view of the nursing indicator included in the preferred embodiment of FIG. 1.

As shown most clearly in FIG. 2, the nursing indicator 16 preferably includes a base member 20 and a designating member 22. The base member 20 and designating member 22 can be constructed from a wide variety of materials commonly used in the art, e.g. plastics, fabrics and, in some instances, stainless steel. Preferably, the selected materials will provide a permanence at least as great as that of the bra itself, will not stain or discolor the bra on washing, and will provide sufficient flexibility (depending on the specific design of the base member 20 and designating member 22) to insure comfort of the wearer.

In the embodiment of FIG. 2, the base member 20 includes a central recess area 24 and sidewalls 26 and 28 which define grooves or tracks 30 and 32. The designating member 22 fits within the recess 24 and has runners or flanges 34 and 36 that fit within grooves 30 and 32. In this way, the designating member 22 is slidably mounted in the track on base member 20. The insert 22 preferably includes some decorative design 38 to enhance the aesthetic appeal of the nursing indicator 16.

The nursing indicator preferably provides at least two positions, generally corresponding to a right position and a left position, in which the nursing indicator is secured. In the embodiment of FIG. 2, a small protuberance 39 is provided on base member 20, projecting upward near the center of recess area 24. The dimensions of the recess 24 and the location of protuberance 39 allow sufficient room within the recess 24 on either side of the protuberance 39 for the designating member 22 to sit between the protuberance 39 and the edges of the recess 24. In this position, the protuberance 38 acts as a "clip", to frictionally impede the insert's motion when the designating member is positioned at a predetermined location on the track, thereby holding the designating member 22 in position. When the mother wishes to move the designating member 22, she simply pushes it over past the clip (protuberance 39) and into the alternate position.

The base member 20 is attached to the nursing bra 10 in any of several manners. In the embodiment of FIG. 2, the base member includes bosses such as boss 40 that define eyelets by which the base member 20 is permanently attached to the nursing bra 10, e.g., by sewing or clamps or rivets. Alternatively, the base member 20 could be removably affixed to the nursing bra 10 by the use of a suitable base-holding member.

Figure 3:
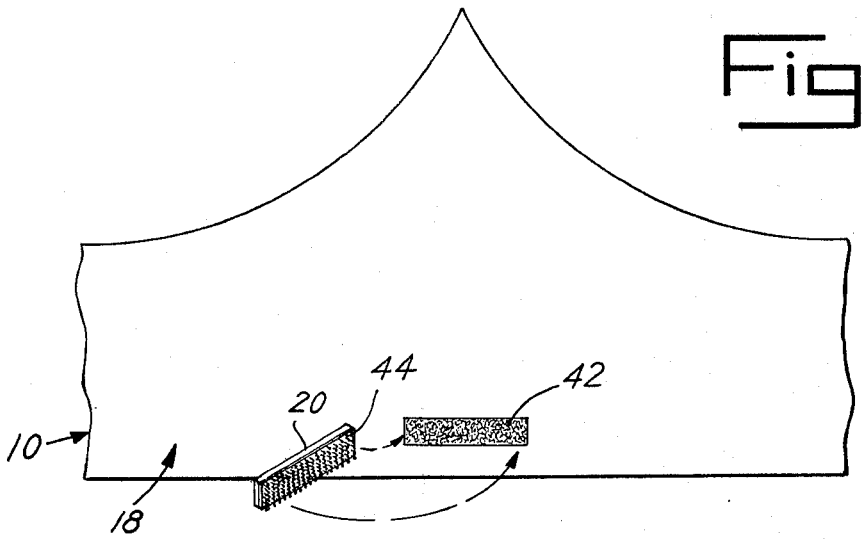
FIG. 3 is a close-up horizontal view of a modification of the nursing indicator shown in FIGS. 1 and 2.

More particularly, as shown in FIG. 3, the nursing indicator shown in FIG. 2, might be modified by affixing a first segment of one mode of interlocking tape 42, such as VELCRO brand interlocking tape, permanently to the nursing bra 10. A second segment 44 of a complementary mode of the interlocking tape is affixed to the backside of base member 20 opposite recess area 24. The base member 20 can be removably affixed to the nursing bra 10 simply by pressing the two segments 42, 44 together. The segments of interlocking tape can be attached to the nursing bra 10 and to the base member 20 by any manner known to one of ordinary skill in the art, e.g., sewing, adhesives, etc.

In the modified embodiment of FIG. 3, the first segment 42 of interlocking tape defines a base-holding member permanently affixed to the nursing bra 10. To highlight the true scope of the invention and its equivalents, it should be noted that the first segment 42 of interlocking tape could alternatively itself be thought of as a base member, or at least a part of a base member.

Figure 4:
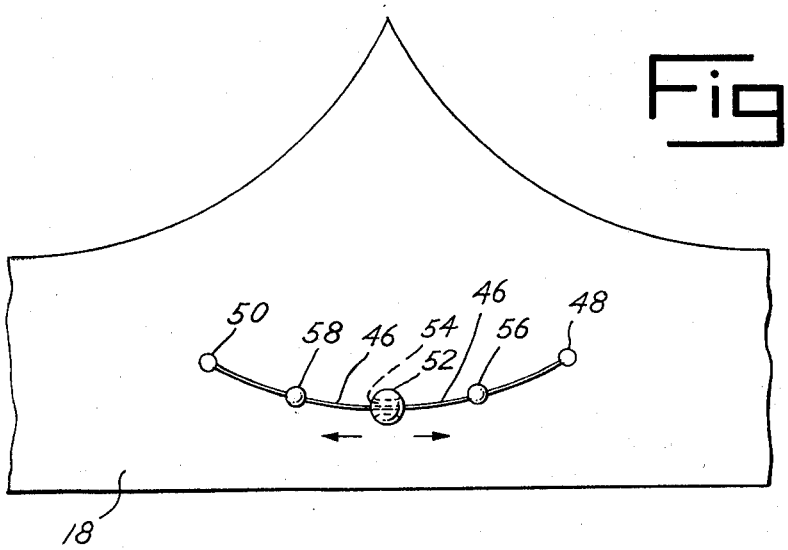
FIG. 4 is a close-up horizontal view of an alternate embodiment of the nursing indicator utilized with the invention.

Referring to FIG. 4, an additional embodiment of the present invention comprises a cord 46 having first and second ends 48 and 50 which are secured to the elastic band 18 such that the first end 48 of the cord 46 is associated with the left breast and the second end 50 of the cord 46 is associated with the right breast. The cord 46 may be affixed to the elastic band 18 using any means known to one of ordinary skill in the art, e.g., sewing, clamps or rivets. A bead 52 having a central passageway 54 therethrough is mounted on the cord 46 by stringing the cord 46 through the central passageway 54. In this way, bead 52 is movably and slidably connected to the cord 46. Smaller beads 56 and 58 are permanently secured to the cord 46, with one of the beads 56 being positioned near first end 48 and the second bead 58 being positioned near the second end 50. Both of the beads 56 and 58 are positioned far enough away from their respective ends so as to allow room for bead 52 to fit between one of the smaller beads 56 and 58 and its respective end 48 and 50. Moreover, the smaller beads 56 and 58 are sized so that they will just barely fit through central passageway 54 of bead 52 with a slight force of hand. In this way, bead 52 can be slid along cord 56, over the smaller beads 56 and 58, and secured between one of the smaller beads and one of the cord ends so as to indicate whether the mother should start with the left or right breast, respectively, when beginning the next feeding.

Figure 5:
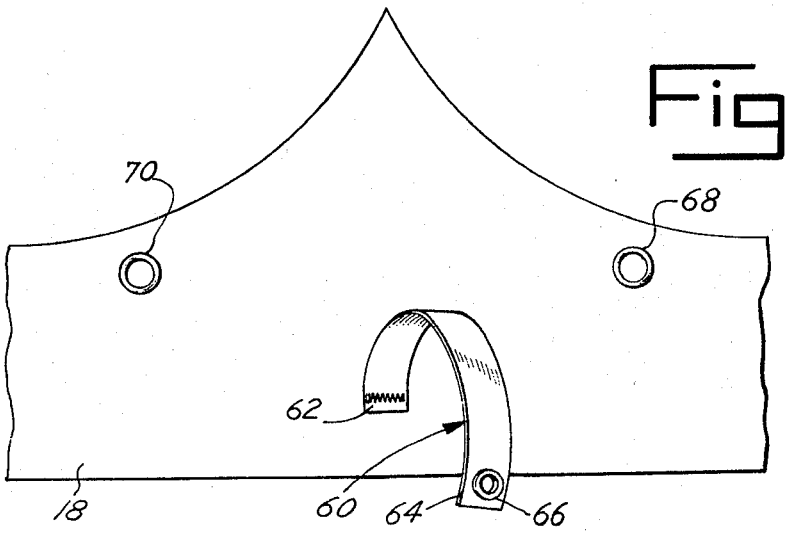
FIG. 5 is a close-up horizontal view of a second alternate embodiment of the nursing indicator utilized with the invention.

Another embodiment of the invention, shown in FIG. 5, involves the use of a strip 60 of flexible material and a conventional snap having male and female interconnecting parts. The flexible strip 60 includes a first end 62 and a second end 64. The first end 62, as shown in FIG. 5, is sewn to the elastic band 18. One of the interconnecting parts 66 of the snap is attached to the second end 64 of the strip 60. Two identical complementary snap parts 68 and 70 are attached near the left and right breast, respectively, on the elastic band 18. In this embodiment, the invention is operated by connecting the snap part 66 in the end 64 of the strip 60 so that it points towards either the left or right breast, respectively. The same technique could be used with a wide variety of interconnecting, complementary part mechanisms.

A still further embodiment of the invention, shown in FIG. 6, involves a strip 72 of flexible material and a buckle member 74. The strip 72 has two ends 76 and 78, each of which is sewn to the elastic band 18 such that the strip 72 extends horizontally from left to right. The flexible strip 72 is inserted through buckle 74 prior to sewing. Once sewing is complete, the buckle 74 slides from left to right and vice versa along the strip 72. As was also the case in connection with the embodiment shown in FIG. 2, the buckle designating member 74 preferably includes a decorative design 80 so as to enhance the aesthetic appeal of the invention.

Referring to FIGS. 7 and 7A, the nursing indicator of this invention also comprises a base member 82 having an arcuate shaped slot 84, the ends of which point downward. The designating member 86 includes a top decorative design and a flange 88 which fits through and secures the designating member within the slot 84. In this embodiment, the force of gravity will normally secure the designating member in the selected position.

FIGS. 8 and 8A show a base member 90 having two openings 92, 94 through the top, visible portion of the base member 90. Both of the openings 92, 94 communicate with a slotted cavity 96 within the base member 90. The designating member comprises a colored disk 92 connected to a handle 100 that projects away from the cavity 96 cut the slotted side of the base member 90. The nursing indicator is operated by sliding the colored disk 92 from side to side by means of the handle 100 such that the colored disk is visible through one of the openings 92, 94.

Figure 9:
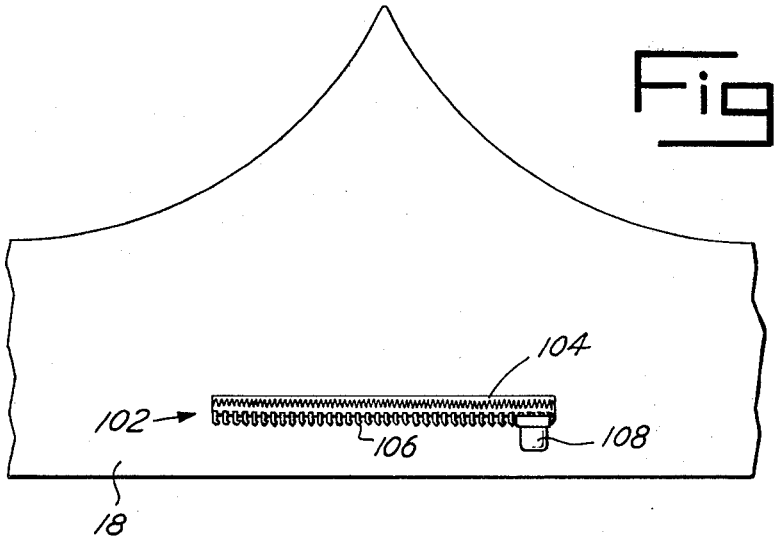
FIG. 9 is a close-up horizontal view of a sixth alternate embodiment of the nursing indicator utilized with the invention.

Referring now to FIG. 9, another embodiment includes a base member 102 that resembles one-half of a zipper. The base member 102 has a band 104 sewn to the elastic band 18 and a rail 106 attached to the sewn band 104. The rail 106 may, but need not, have teeth as does a zipper. A pull portion 108 of a zipper is mounted on the rail 106 to slide back and forth and indicate the breast to be used in starting a feed.

Figure 10:
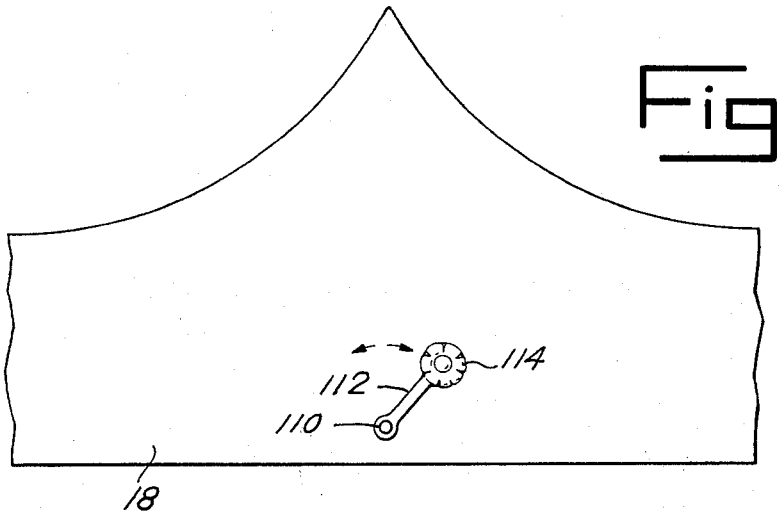
FIG. 10 is a close-up horizontal view of a seventh alternate embodiment of the nursing indicator utilized with the invention.

In embodiment of FIG. 10, the base member comprises a simple rivet 110 or clamp. The designating member comprises a rod or arm 112 which rotates about the rivet 110. In particular, the arm is easily rotated from left to right, and vice versa, using one hand. The base member is advantageously designed such that the arm 112 rotates in no more than a 180° arc, preferably between horizontal positions in relation to the wearer.

Figure 11:
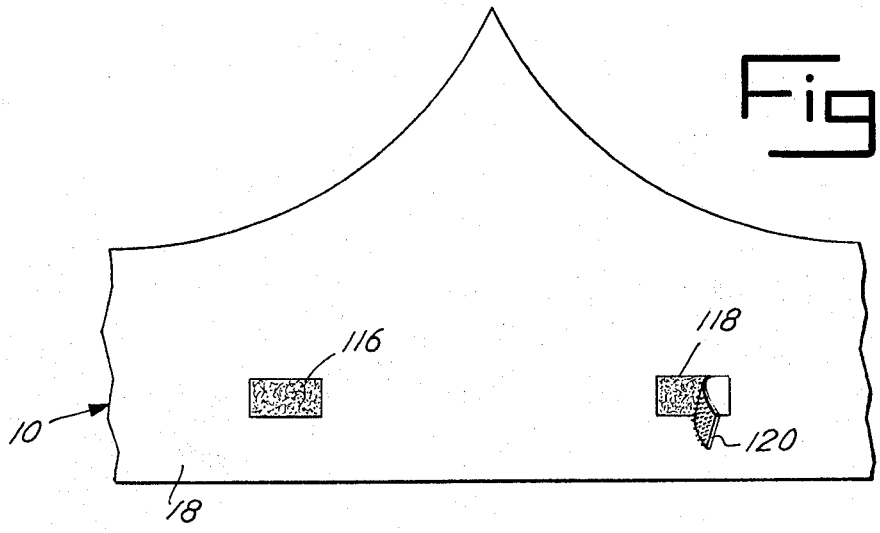
FIG. 11 is a close-up horizontal view of an eighth embodiment of the nursing indicator utilized with the invention.

In still a further, particularly simple, embodiment shown in FIG. 11, the base member comprises two pieces 116 and 118 of a first mode of interlocking tape, such as VELCRO band interlocking tape. One piece 116 is fastened to the bra 10 near one breast, and a second piece 118 is fastened to the bra 10 near the other breast. The designating member comprises a segment 120 of the complementary mode of interlocking tape.

While in the foregoing, there has been provided a detailed description of several embodiments of the present invention, it is to be understood that additional embodiments will appear to those of ordinary skill in the art. For example, although all of the nursing indicators shown herein employ mechanical constructions where movement from one position to another is clearly visible, it would be possible to employ a microelectronic device using LCD or other visual display where movement, in the mechanical sense, would not be readily apparent. Moreover, many techniques for securing a designating member in a particular position, in addition to those shown here, will be known to those of ordinary skill in the art. All equivalents to the invention described and claimed herein are included within the scope of the claims.

What is claimed is:

1. In an improved nursing bra having left and right breast cups that are at least partially detachable to thereby form an opening near the left or right breast, respectively, an improvement comprising:

nursing indicator means for safely and easily designating which breast is to be used when starting a breast-feeding of an infant, said nursing indicator means being permanently fastened to the bra.

2. An improved nursing bra as claimed in claim 1, wherein the nursing indicator means further comprises:

a base member fastened to the bra; and a designating member affixed to the base member.

3. An improved nursing bra as claimed in claim 1 wherein at least a portion of the designating member is movable in relation to at least a portion of the base member to indicate which breast is to be used when starting a breast feeding of an infant.

4. An improved nursing bra as claimed in claim 2, wherein the designating member can be secured in either of at least two positions.

5. An improved nursing bra as claimed in claim 2, wherein the base member comprises a body defining a track and the designating member comprises an insert slideably mounted on the track.

6. An improved nursing bra as claimed in claim 4, wherein the base member further comprises one or more raised protuberances on the track to frictionally impede the insert'motion when the designating member is positioned at predetermined locations on the track.

7. An improved nursing bra as claimed in claim 2, wherein the designating member is rotatably attached to the base member.

8. An improved nursing bra as claimed in claim 2, wherein the base member comprises a segment of cord affixed to the bra, and the designating member comprises a bead with a passageway therethrough, the cord being inserted through the passageway for slideable movement of the bead along the cord.

9. In an improved nursing bra having left and right breast cups that are at least partially detachable to thereby form an opening near the left or right breast, respectively, an improvement comprising:

a base-holding member which is permanently affixed to the bra;

a base member permanently affixed to the base-holding member; and a designating member permanently affixed to the base member, at least a portion of the designating member being movable in relation to at least a portion of the base member for indicating which breast is to be used when starting a breast-feeding of an infant.

* * * * *